US006218989B1

(12) United States Patent
Schneider et al.

(10) Patent No.: US 6,218,989 B1
(45) Date of Patent: Apr. 17, 2001

(54) MINIATURE MULTI-BRANCH PATCH ANTENNA

(75) Inventors: Martin Victor Schneider, Holmdel; Cuong Tran, Howell, both of NJ (US)

(73) Assignee: Lucent Technologies, Inc., Murray Hill, NJ (US)

( * ) Notice: Subject to any disclaimer, the term of this patent is extended or adjusted under 35 U.S.C. 154(b) by 956 days.

(21) Appl. No.: 08/698,169

(22) Filed: Aug. 8, 1996

Related U.S. Application Data

(63) Continuation of application No. 08/365,263, filed on Dec. 28, 1994, now abandoned.

(51) Int. Cl.[7] ..... H01Q 1/38; H01Q 1/52
(52) U.S. Cl. ..... 343/700 MS; 343/841
(58) Field of Search ..... 343/700 MS, 841, 343/844, 853; H01Q 1/36, 1/38, 1/52

(56) References Cited

U.S. PATENT DOCUMENTS

| | | | | |
|---|---|---|---|---|
| 2,573,914 | * | 11/1951 | Landon | 343/841 |
| 3,541,559 | | 11/1970 | Evans | 343/756 |
| 4,291,312 | | 9/1981 | Kaloi | 343/700 MS |
| 4,460,894 | * | 7/1984 | Robin et al. | 343/841 |
| 4,783,661 | * | 11/1988 | Smith | 343/700 MS |
| 4,912,482 | * | 3/1990 | Woloszczuk | 343/841 |
| 5,173,711 | * | 12/1992 | Takeuchi et al. | 343/700 MS |
| 5,231,407 | * | 7/1993 | McGirr et al. | 343/700 MS |
| 5,453,754 | * | 9/1995 | Fray | 343/700 MS |

FOREIGN PATENT DOCUMENTS 0 450 881 A3 10/1991 (EP) .
2 238 665 6/1991 (GB) .

OTHER PUBLICATIONS

Chen et al., "Superstrate Loading Effects on the Circular Polarization and Crosspolarization Characteristics of a Rectangular Microstrip Patch Antenna," IEEE Trans. Antennas and Propagation, V42(2), Feb. 1994, pp. 260–264.

Kyriacou et al., "Effects of Substrate–Superstrate Uniaxial Anisotropy on Microstrip Structures," Elec. Letts., V30(19), Sep. 1994, pp. 1557–1558.

Pozar, D.M., "Microstrip Antennas," Proceedings of the IEEE, vol. 80, No. 1, Jan. 1992, pp. 79–91.

* cited by examiner

*Primary Examiner*—Michael C. Wimer
(74) *Attorney, Agent, or Firm*—DeMont & Breyer, LLC; Wayne S. Breyer; Jason Paul DeMont

(57) ABSTRACT

A miniature, multi-branch patch antenna suitable for operating in the 1 GHz to 100 GHz frequency range, a method for making same and a communication system using the same is disclosed. In one embodiment, the antenna comprises a planar dielectric substrate, a plurality of conducting antenna elements each having a feed port, a ground plane and a septum located between each conducting antenna element. In a second embodiment, the antenna comprises a planar dielectric substrate, a plurality of conducting antenna elements each having a feed port, a ground plane and a superstrate that is disposed on the plurality of conducting antenna elements and at least a portion of the dielectric substrate. The septum and the superstrate suppress undesirable coupling mechanisms. In a communication system according to the present invention, the miniature, multi-branch patch antenna is coupled to a transmitter and/or receiver.

28 Claims, 4 Drawing Sheets

MINIATURE MULTI-BRANCH PATCH ANTENNA

This application is a continuation of application Ser. No. 08/365,263 filed on Dec. 28, 1994, abandoned.

FIELD OF THE INVENTION

This invention relates to miniature patch antennas, and more particularly to miniature patch antennas having polarization and space diversity, as well as to improved communications systems employing such antennas.

BACKGROUND OF THE INVENTION

A typical microstrip or miniature patch antenna has a metallic patch printed on a thin grounded dielectric substrate. In the transmitting mode, a voltage is fed to the patch that excites current on the patch and creates a vertical electric field between the patch and the ground plane. The patch resonates when its length is near $\lambda/2$, leading to relatively large current and field amplitudes. Such an antenna radiates a relatively broad beam normal to the plane of the substrate. The patch antenna has a very low profile and can be fabricated using photolithographic techniques. It is easily fabricated into linear or planar arrays and readily integrated with microwave integrated circuits.

Disadvantages of early patch antenna configurations included narrow bandwidth, spurious feed radiation, poor polarization purity, limited power capacity and tolerance problems. Much of the development work relating to miniature patch antennas has been directed toward solving these problems.

For example, early miniature patch antennas used direct feeding techniques wherein the feed line runs directly into the patch. Such direct feed arrangements sacrificed bandwidth for antenna efficiency. In particular, while it was desirable to increase substrate thickness to increase bandwidth, this resulted in an increase in spurious feed radiation, increased surface wave power, and potentially increased feed inductance. More recently, noncontacting feed arrangements, such as the aperture coupled antenna have been developed. In the aperture coupled antenna, two parallel substrates are separated by a ground plane. A feed line on the bottom substrate is coupled through a small aperture in the ground plane to a patch on the top substrate. This arrangement allows a thin, high dielectric constant substrate to be used for the feed and a thick, low dielectric constant substrate to be used for the antenna element, allowing independent optimization of both the feed and the radiation functions. Further, the ground plane substantially eliminates spurious radiation from the feed from interfering with the antenna pattern or polarization purity.

Perhaps the most serious drawback of the earlier miniature patch antennas were their narrow bandwidth. Typical approaches to overcome this drawback can be characterized as either using an impedance matching network or parasitic elements.

Notwithstanding the improvements in miniature patch antennas, a need exists for a miniature patch antenna having enhanced radiation efficiency, increased antenna bandwidth and reduced electromagnetic coupling.

SUMMARY OF THE INVENTION

The aforementioned need, as well as others, are met by a miniature multi-branch patch antenna having at least two separate conducting antenna elements. The conducting antenna elements, each having a feed port, are disposed on a first surface of a planar dielectric substrate. A ground plane is disposed on a second surface of the planar dielectric substrate. Each conducting antenna element is separated from all other conducting antenna elements by a septum which is in electrical contact with a conducting ground plane.

In another embodiment, the miniature multi-branch patch antenna may further comprise a superstrate disposed on top of the conducting antenna elements and at least a portion of the substrate. In a further embodiment, the miniature multi-branch patch antenna may include the superstrate but not the septum. Both the septum and superstrate aid in suppressing undesirable coupling mechanisms.

In an additional embodiment, a communication system is formed comprising at least one miniature multi-branch patch antenna, a transmitter and a receiver.

BRIEF DESCRIPTION OF THE DRAWINGS

Other features of the present invention will be more readily understood from the following detailed description of specific embodiments thereof when read in conjunction with the accompanying figures in which.

DETAILED DESCRIPTION OF THE INVENTION

Figure 1:
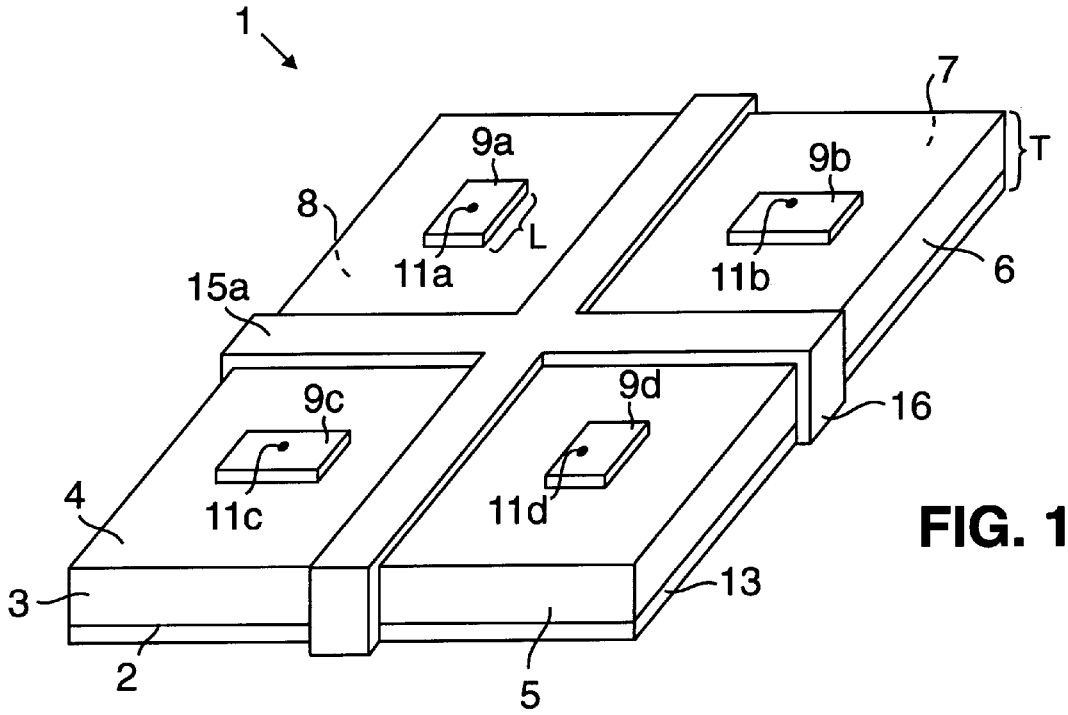
FIG. 1 shows an embodiment of a miniature multi-branch patch antenna according to the present invention.

FIG. 1 shows an exemplary embodiment of a patch antenna 1 according to the present invention. As illustrated, the patch antenna 1 has four separate conducting antenna elements 9*a*, 9*b*, 9*c* and 9*d*. For convenience, the conducting antenna elements 9*a* –9*d* may be collectively referred to by the reference numeral 9. A patch antenna 1 according to the present invention will perform adequately with only two conducting antenna elements 9, however, increasing the number of conducting antenna elements 9 improves diversity. It will be appreciated that the size constraints for a particular application may limit the number of conducting antenna elements 9 that can be incorporated in a patch antenna 1 according to the present invention. For example, the patch antenna 1 of FIG. 1, having four conducting antenna elements 9, is a preferred arrangement if the antenna 1 is to be used in conjunction with a handheld cellular phone. Four such conducting antenna elements 9, approximately one-half inch in length and spaced from adjacent elements by 1 inch center-to-center, can be arranged on a 2 inch by 2 inch substrate 3.

The conducting antenna elements 9 are partially embedded in a dielectric substrate 3 having a first surface 4 and a second surface 2. Each conducting antenna element 9 has a single feed port 11. Thus, four feed ports, identified by the reference numerals 11*a*, 11*b*, 11*c* and 11*d* are associated with the four conducting antenna elements 9*a*, 9*b*, 9*c* and 9*d*, respectively, in the embodiment shown in FIG. 1. For convenience, the feed ports may be collectively referred to by the reference numeral 11.

The patch antenna 1 also includes a septum 15*a*. In the embodiment shown in FIG. 1, the septum 15*a* is a layer of metal disposed on the first surface 4 of the dielectric substrate 3. The septum 15*a* is in electrical contact with a ground plane 13, located on the second surface 2 of the dielectric substrate. The septum 15*a* reduces coupling between the conducting antenna elements 9. In particular, the septum 15*a* blocks surface waves from propagating from one conducting antenna element 9 to another such element. In addition, the septum 15*a* reduces parasitic capacitive coupling between conducting antenna elements 9. The septum 15*a* also functions as a partial electromagnetic shield between conducting antenna elements 9.

The conducting antenna elements 9, the ground plane 13, and the septum 15*a* shown in FIG. 1 may be formed of an appropriate metal, including, without limitation, copper, gold plated copper and nickel. The dielectric substrate 3 may be a ceramic such as $BaTiO_3$, or other suitable ceramics having a high Q value and a high dielectric constant such as those discussed by Konishi in "Novel Dielectric Waveguide Components—Microwave Applications of New Ceramic Materials," Proc. IEEE, vol. 79(6), (June 1991) at 726. This reference, and all others mentioned in this specification, are incorporated herein by reference. As will be appreciated by those skilled in the art, the choice of a dielectric for use as the dielectric substrate 3 will be governed primarily by its associated dielectric constant.

As previously noted, in the embodiment shown in FIG. 1, the septum 15*a* is a layer of metal disposed on the surface 4 of the dielectric substrate 3. The septum 15*a* is arranged so that a portion of the septum passes between adjacent conducting antenna elements 9. In this manner, each conducting antenna element 9 is separated from every other conducting antenna element by the septum 15*a*.

An exemplary structure of the septum 15*a* is shown in FIG. 1 for a patch antenna 1 having four conducting antenna elements 9*a–d*. The septum 15*a* traverses the surface 4 in a crisscross pattern from the surface 6, across the surface 4 to the surface 8, and from the surface 7 across the surface 4 to the surface 5. Each terminus 16 of the septum 15*a* is in electrical contact with the ground plane 13.

Figure 2:
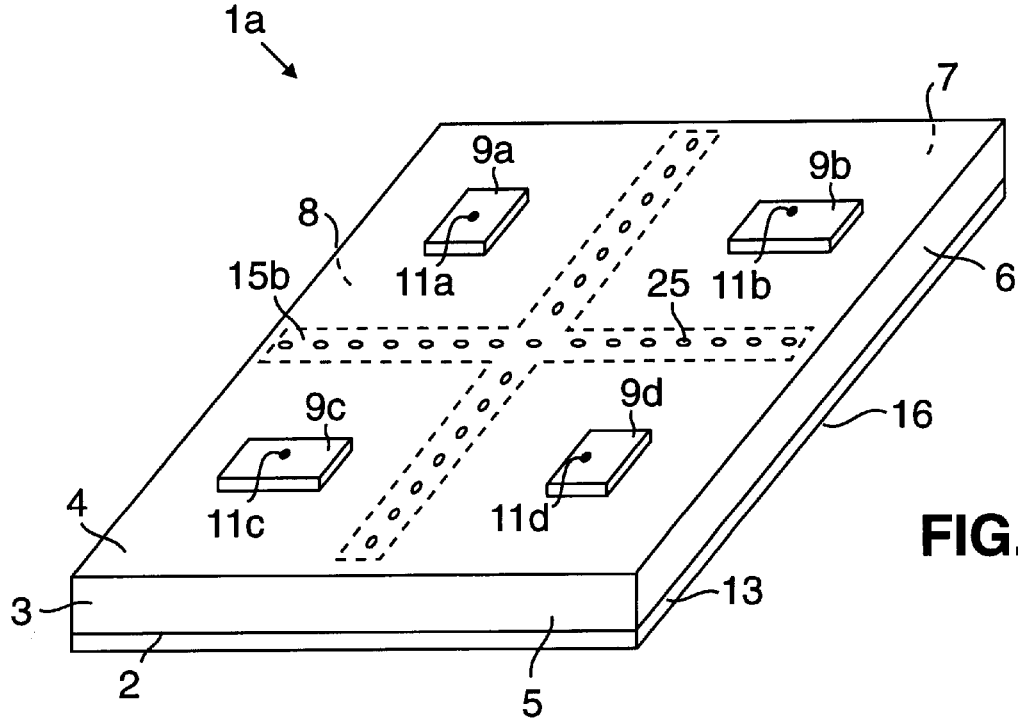
FIG. 2 shows an alternate embodiment of the miniature multi-branch patch antenna shown in FIG. 1.

A second embodiment of a patch antenna according to the present invention is shown in FIG. 2. This embodiment comprises many of the same features as the embodiment shown in FIG. 1, including the dielectric substrate 3, the conducting antenna elements 9 each having a feed port 11, and the ground plane 13. The embodiment of patch antenna 1*a* shown in FIG. 2 further comprises a septum 15*b*, the structure of which is different than that of the septum 15*a* of FIG. 1. The septum 15*b* depicted in FIG. 2 is comprised of a plurality of via holes 25. The via holes are metallized holes which pass through the dielectric substrate 3 and terminate in the ground plane 13. The via holes 25 are spaced from each other by about one-tenth of the carrier wavelength, as measured in the substrate 3. Notwithstanding the differences in structure between the septums 15*a* and 15*b*, they serve the same purpose of reducing coupling between individual conducting antenna elements 9.

In FIG. 2, the plurality of via holes 25 of the septum 15*b* are shown arranged in a crisscross pattern similar to the arrangement of the fully metallized septum 15*a* of FIG. 1. It should be appreciated that as the number of conducting antenna elements 9 varies from the four such elements shown in FIGS. 1 and 2, the shape of the septums utilized may vary from the crisscross arrangement of the septums 15*a* and 15*b* shown in those Figures.

Turning now to a discussion of the dielectric substrate 3, the thickness T of the dielectric substrate 3 should be a small fraction of the carrier signal wavelength. As is known to those skilled in the art, the thickness T of the dielectric substrate 3 should be, at most, about one-tenth of a wavelength of the carrier frequency as measured in the dielectric substrate. Preferably, the thickness T of the dielectric substrate 3 is less than one-tenth of the carrier wavelength. Using a dielectric substrate 3 having a high relative dielectric constant minimizes antenna size. For example, for an antenna 1 or 1*a* operating at a carrier frequency of 2 GHz having a barium titanate, $BaTiO_3$, substrate with an $\epsilon_r$ of 38.0, the thickness T of the substrate 3 should be about 0.09 inches. Such a configuration will result in an antenna radiation efficiency of about 55 to 65 percent. The patch antennas 1 and 1*a* have a multi-branch structure. In other words, these antennas have at least two physically separate conducting antenna elements 9. In fact, the patch antennae 1 and 1*a* shown in FIGS. 1 and 2 have four physically separate conducting antenna elements 9. As noted above, in other embodiments, more or less conducting antenna elements 9 could be suitably employed. A minimum of two physically separate conducting antenna elements 9 are required to attain space diversity. A sufficient degree of space diversity is obtained if the covariance functions of the field envelopes become small as described by Jakes in *Microwave Mobile Communications,* (John Wiley & Sons, 1974) at p. 36–39.

For an idealized case, adjacent conducting antenna elements 9 should be spaced by one-half of the wavelength of the carrier frequency. If, however, the conducting antenna elements 9 are fully embedded in a dielectric material having a relative dielectric constant $\epsilon_r$, the separation between the conducting antenna element 9 should be at least $\lambda_0/2\sqrt{\epsilon_r}$, where $\lambda_0$ is the wavelength of the carrier signal in a vacuum. For example, the minimum required separation for conducting antenna elements 9 using a carrier frequency of 2 GHz ($\lambda_0$=6"), where the dielectric substrate is a ceramic such as barium titanate ($\epsilon_r$=38.0) is $6/2\sqrt{38}$=0.49 inches.

In the embodiments of a miniature multi-branch patch antenna shown in FIGS. 1 and 2, the conducting antenna elements 9 are not fully embedded in the dielectric substrate 3. In other words, the conducting antenna elements 9 extend above the surface 4 of the dielectric substrate 3. As such, a fraction of the generated electromagnetic field is stored in the dielectric substrate 3 and a lesser fraction is stored in the air above the dielectric substrate 3. In this case, the required spacing of conducting antenna elements 9 is given by $\lambda_0/2\sqrt{\sqrt{\epsilon_{eff}}}$ where $\epsilon_{eff}$ is the effective dielectric constant of the specific configuration. $\epsilon_{eff}$ is about 90 percent of $\epsilon_r$. $\epsilon_{eff}$ may be calculated according to the teachings of Schneider et al. in "Microwave and Millimeter Wave Hybrid Integrated Circuits for Radio Systems," Bell Systems Tech. J., Vol. 48(6), (July–Aug. 1969), p. 1703.

As will be appreciated by those skilled in the art, the length L of the conducting antenna element 9 should be about one-half of the carrier signal wavelength in the dielectric substrate 3. At a carrier frequency of 2 GHz, this results in a length L for the antenna element 9 of about 0.5 inches. The optimal size is slightly shorter because of parasitic fringe fields at both ends of the conducting antenna elements 9.

Figure 3:
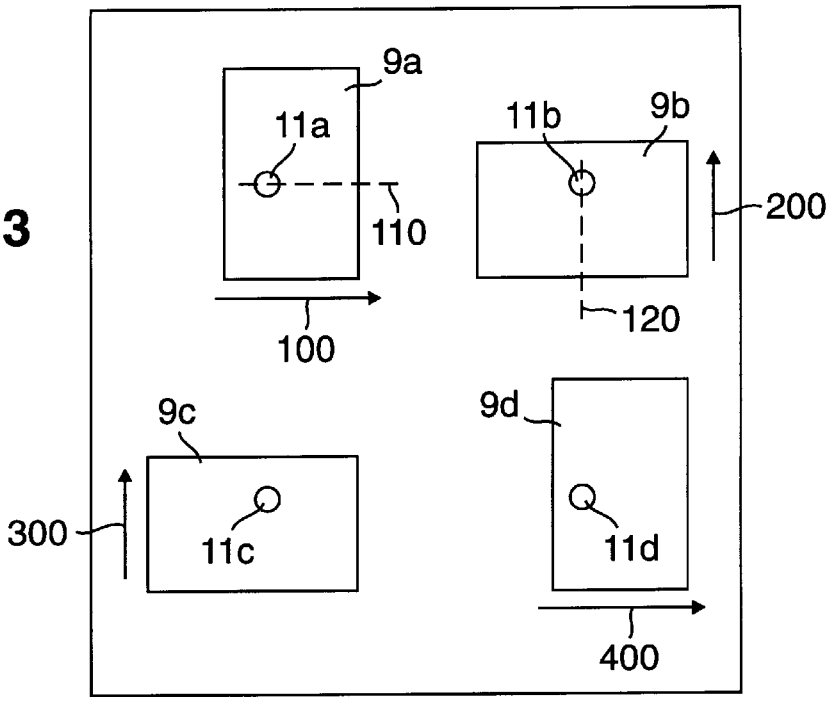
FIG. 3 illustrates an embodiment of an arrangement of conducting antenna elements according to the present invention.

FIG. 3 shows additional details of the conducting antenna elements 9*a–d* shown in FIGS. 1 and 2. As illustrated in FIG. 3, the conducting antenna elements 9*a*, 9*b* are preferably arranged so that the respective E-fields 100, 200 are orthogonal with respect to each other, minimizing the coupling between the feed points 11*a* and 11*b*. Likewise, the E-fields 300, 400 of antenna elements 9*c* and 9*d*, respectively, are preferably orthogonal with respect to each other. Thus, the patch antennas 1 and 1*a* of the present invention have polarization diversity.

Note that in the arrangement shown in FIGS. 1, 2 and 3, the center-to-center spacing for conducting antenna elements having the same polarization, such as 9*a* and 9*d* or 9*b* and 9*c*, is greater than the center-to-center spacing of conducting antenna elements having orthogonally related polarizations, such as 9*a* and 9*b* or 9*c* and 9*d*. Specifically, according to the arrangement shown in FIGS. 1, 2 and 3, if conducting antenna elements 9*a* and 9*b*, 9*a* and 9*c*, 9*c* and 9*d*, and 9*b* and 9*d* have a 1 inch center-to-center spacing, then the center-to-center spacing between conducting antenna elements 9*a* and 9*d*, and 9*b* and 9*c* is 1 inch * $\sqrt{2}$. Since the strongest coupling is observed between elements 9 having the same polarization, an arrangement that maximizes the distance between identically polarized conducting antenna elements 9 is preferred. This distance may be maximized, for example, by arranging the conducting antenna elements 9 so that identically polarized elements are on a diagonal with respect to each other, as shown in FIGS. 1, 2 and 3. As used in this specification, the term "adjacent," when used to describe the relative positions of conducting antenna elements 9, excludes elements having a diagonal orientation with respect to each other, such as conducting antenna elements 9*a* and 9*d* or 9*b* and 9*c* of FIGS. 1, 2 and 3.

Figure 4:
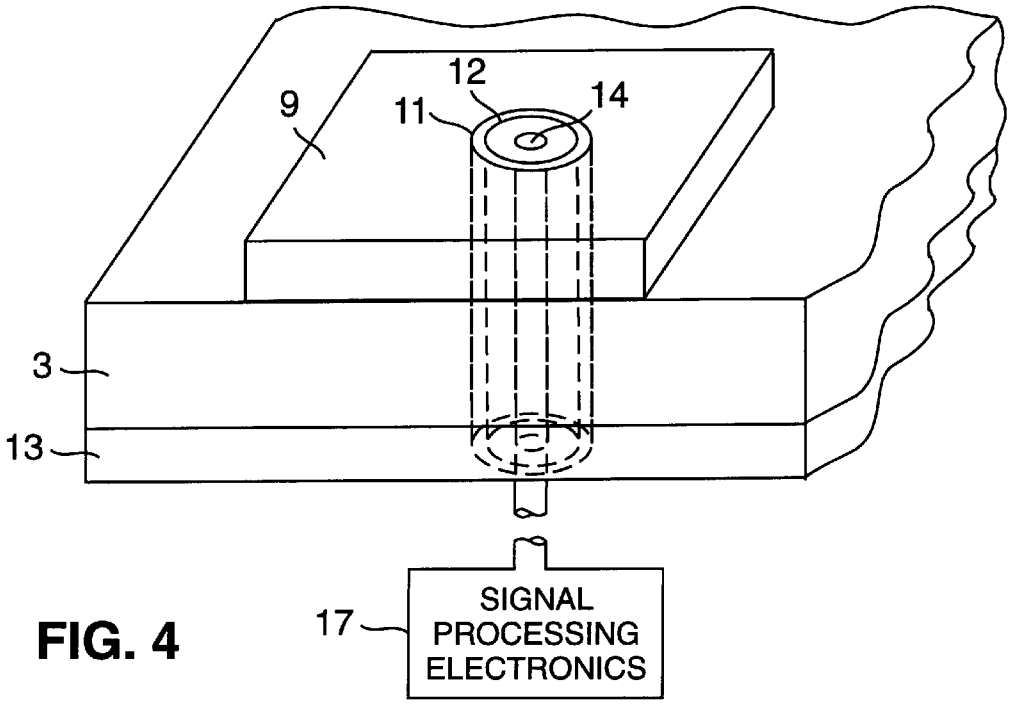
FIG. 4 illustrates an embodiment of a feed port arrangement according to the present invention.

Each conducting antenna element 9 has its own feed port 11. As best illustrated in FIG. 4, the feed port 11 conducts a signal to, or away from, the conducting antenna element 9. As used herein, the term feed port, sometimes referred to as an antenna port by those skilled in the art, refers to the point of electrical contact between the conducting antenna elements and signal processing electronics 17 such as, without limitation, amplifiers, modulators, demodulators, receivers, transmitters and duplexers. Each feed port 11 thus comprises a hole and a conductor 14 within the hole. The term "metallized hole" is often used to refer to such an arrangement.

Thus, each feed port 11 may suitably be a metallized hole through the ground plane 13, the dielectric substrate 3, and the conducting antenna element 9. The conductor 14 disposed within each hole must be in electrical contact with the conducting antenna element 9 and electrically isolated from the ground plane 13. As such, an insulated pin or other suitable arrangement 12 for electrically isolating a conductor 14 should be used within the hole as shown in FIG. 4.

As shown in FIG. 3, the feed ports 11*a* and 11*b* are preferably located on the symmetry axes 110, 120 of the conducting antenna elements 9*a*, 9*b*, respectively. The impedance of a feed port 11 may be varied by changing its position on the symmetry axis. In particular, the feed ports 11*a*, 11*b* are preferably located off-center on the symmetry axes 110, 120 to achieve a port impedance of about 50 ohms (Ω). The feed ports 11*c* and 11*d* of the conducting antenna elements 9*c* and 9*d* are similarly arranged.

Figure 5:
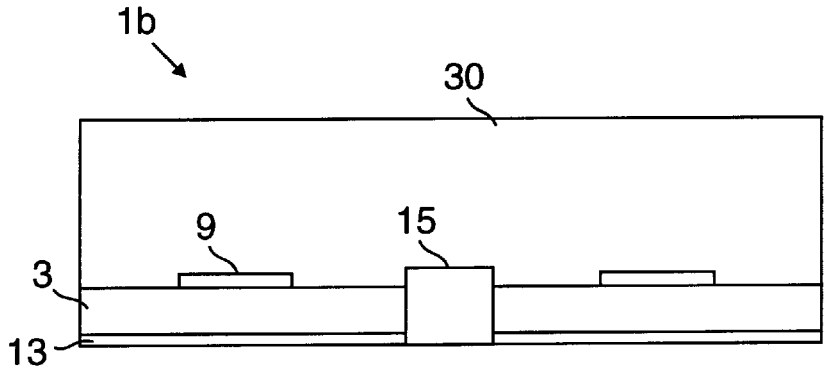
FIG. 5 shows a further embodiment of a miniature multi-branch antenna according to the present invention comprising a superstrate.

In a preferred embodiment, shown in FIG. 5, a miniature multi-branch patch antenna 1*b* according to the present invention further comprises a dielectric superstrate 30. The superstrate 30, which is located on top of the first surface 4 of the substrate 3 and the conducting antenna elements 9, substantially enhances radiation efficiency of the antenna. Radiation efficiency is enhanced through an improved impedance match of the conducting antenna elements 9 to free space by reducing undesirable coupling mechanisms and the excitation of surface waves.

The relative dielectric constant of the dielectric superstrate 30 should be approximately equal to the square root of the relative dielectric constant of the dielectric substrate 3. Thus, for a dielectric substrate 3 having an $\epsilon_r$ of 38, the relative dielectric constant of the superstrate 30 should be about 6.2. With the superstrate 30 present, the dielectric constant drops from $\epsilon_r$ to $\epsilon$ superstrate to 1 as one moves from the substrate 3 to the superstrate 30 to free space. Without the superstrate 30 present, the dielectric constant falls from $\epsilon_r$ to 1. The more gradual drop in dielectric constant when the superstrate 30 is present results in a decrease in surface waves.

By way of example, the superstrate 30 may be formed of materials such as alumina, steatite, fosterite, or ceramics having an appropriate dielectric constant. Other suitable materials may also be employed.

To obtain the best impedance match to free space, the thickness of superstrate 30 should be equal to one-quarter of the carrier wavelength, as measured in the superstrate. For the case of a substrate with an $\epsilon_r$ of 38 and a carrier frequency of 2 GHz, the superstrate 30 should be about 0.6 inches thick. For this example, the superstrate 30 is preferably thus about six to seven times thicker than the substrate 3.

Figure 6:
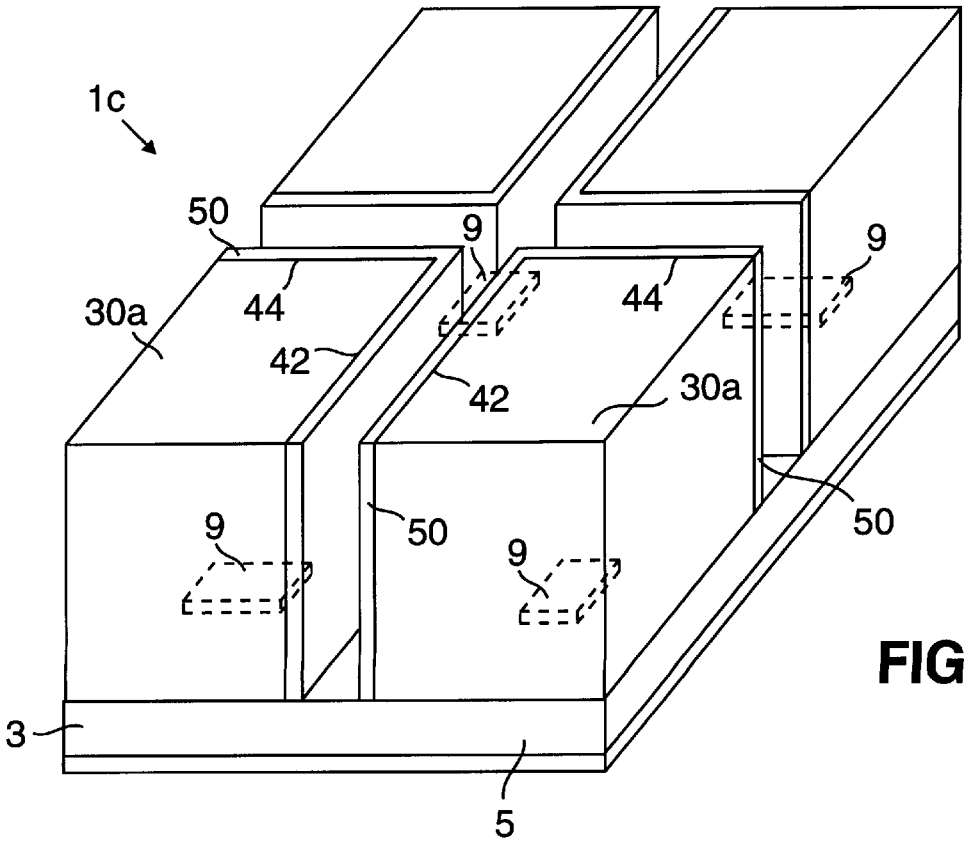
FIG. 6 shows a preferred embodiment of a miniature multi-branch antenna of FIG. 5 wherein the superstrate is segmented.

An alternate preferred embodiment of a miniature multi-branch patch antenna 1*c* incorporating a superstrate is shown in FIG. 6. In the embodiment shown in FIG. 6, the superstrate is segmented so that each conducting antenna element 9 has associated with it a region or portion of superstrate 30*a* which does not physically contact the superstrate 30*a* associated with any other conducting antenna element 9. In a preferred embodiment, a metal layer 50 is disposed on the inside edges 42 and 44 of each segment of superstrate 30*a*. This metal layer 50 further reduces parasitic coupling effects between antenna elements 9 and improves the impedance match to the free space impedance.

The metal layer 50 is preferably grounded using a septum, such as the septum 15*a* or 15*b*. This results in enhanced radiation efficiency, increased antenna bandwidth and reduced electromagnetic coupling between separate conducting antenna elements.

If the metal layer 50 is to be grounded, and a septum comprised of via holes, such as the holes 25 of the septum 15*b* shown in FIG. 2 employed, the via holes must be in electrical contact with the metal layer 50. This contact may be accomplished by incorporating a layer of metal on the surface 4 of the dielectric substrate 3 between each segment of the superstrate 30*a*, the conductive portion of the via holes being in contact with the layer of metal. Alternatively, the via holes may be formed in the dielectric substrate 3 substantially directly beneath the metal layer 50, establishing electrical contact. Other arrangements suitable for electrically connecting the via holes to the metal layer 50 that occur to those skilled in the art may, of course, also be used.

The patch antennas 1–1*c* of the present invention may be formed as follows. The initial steps for forming the various embodiments of the patch antenna are common to all embodiments. In particular, a high dielectric K substrate having flat, parallel surfaces is first cleaned. The substrate is then metallized on both its top and bottom surface with copper or another suitable metal. The metal on one surface of the substrate will thus form the ground plane 13, and the metal on the other surface will be patterned into the conducting antenna elements and the septum as discussed in more detail below. The metal is applied by electrodeless plating or vacuum evaporation or other suitable methods.

Next, photolithographic methods are used to define the conducting antenna elements 9. In particular, photoresist is applied to a first surface of the dielectric substrate 3. The photoresist is exposed to appropriate radiation, typically ultraviolet light, which will either increase or decrease the solubility of the photoresist compared to unexposed photoresist. The radiation is projected through a mask that, depending upon the type of photoresist, either exposes only the photoresist at the sites where the conducting antenna elements 9 will be patterned or exposes all photoresist except for the photoresist at the sites where the conducting antenna elements 9 will be patterned. After exposure, higher solubility photoresist is removed by a solvent, leaving regions of photoresist at the sites where the conducting antenna elements 9 will be patterned. These regions of photoresist protect underlying metal while all uncovered metal is removed, in the next step, from the first surface of the substrate. The remaining photoresist is then removed, leaving discrete regions of metal on the first surface of the substrate. These regions form the conducting antenna elements 9.

Each feed port 11 is formed by first forming a hole through the conducting antenna elements 9, the dielectric substrate 3 and the ground plane 13 using an appropriate device such as a laser or a diamond drill. The portion of the ground plane 13 immediately surrounding the portion of the hole passing therethrough is removed. An insulated pin or other means for insulating the conductor 14 from the ground plane 13 is inserted or applied, and fixed within the feed port 11.

If a fully metallized septum is to be formed, such as the septum 15*a* of the patch antenna 1 shown in FIG. 1, it is patterned at the same time as the conducting antenna elements 9 using a suitably configured mask.

If a septum comprising a plurality of via holes is to be formed, such as the septum 15*b* shown in FIG. 2, the holes are formed by an appropriate device such as a laser or a diamond drill after the conducting antenna elements 9 are patterned. Regarding via hole formation, once a hole is formed, it must be treated so that it is electrically conductive. Without limitation, suitable treatment includes filling the hole with a conductive epoxy or a placing a metal wire through the hole or both. Alternatively, the holes may be "through-plated," however, this should preferably be done prior to patterning the conducting antenna elements.

As depicted in FIG. 5, the patch antenna 1*b* may incorporate a superstrate 30 over a fully metallized septum 15*a*. If so, the superstrate 30 is incorporated after completing the aforementioned steps. An appropriately sized and shaped superstrate 30 is first formed using techniques known to those skilled in the art. Once the superstrate 30 is formed, sized and shaped, it is bonded to the substrate 3 using a layer of epoxy. A superstrate 30 may likewise be used in conjunction with a septum like the septum 15*b* of FIG. 2. Again, the superstrate is bonded to the dielectric substrate 3 after forming the via holes comprising the septum 15*b*.

In some embodiments of a patch antenna 1 according to the present invention, such as the embodiment shown in FIG. 6, the patch antenna 1 may incorporate a superstrate 30*a*, but not a septum. If this is the case, then the superstrate 30 or 30*a* is bonded to the dielectric substrate 3 after the feed ports are formed and feed lines inserted therein. If the patch antenna 1 utilizes a partially metallized, segmented superstrate 30*a* as shown in FIG. 6, the superstrate 30*a* must be formed, sized, shaped and metallized prior to bonding to the dielectric substrate 30. Metal may be disposed on the superstrate 30*a* using the electrodeless plating, vacuum deposition or other suitable methods known to those skilled in the art.

If the patch antenna 1 utilizes a partially metallized, segmented superstrate 30*a* which is grounded utilizing a fully metallized septum that contacts the ground plane 13, such as the septum 15*a* of FIG. 1, the septum should be patterned at the same time that the conducting antenna elements 9 are patterned. The septum must be patterned so that the septum is in electrical contact with the metal layer 50 on the superstrate 30*a*. If via holes are to be used in conjunction with a metallized region between the segmented superstrate 30*a*, then the metal region must be patterned when the conducting antenna elements 9 are patterned, and via holes are subsequently formed. The conductive portion of the via holes must be in electrical contact with the metallized region which must, of course, be in electrical contact with the metal layer 50 on the substrate 30*a*.

Alternatively, the partially metallized, segmented superstrate 30*a* can be grounded by forming via holes which are located in the dielectric substrate 3 so that when the metallized segmented superstrate 30*a* is bonded to the dielectric substrate 3, the via holes and the metal layer 50 are in electrical contact. In this case, it is preferable to use a conductive epoxy.

Figure 7:
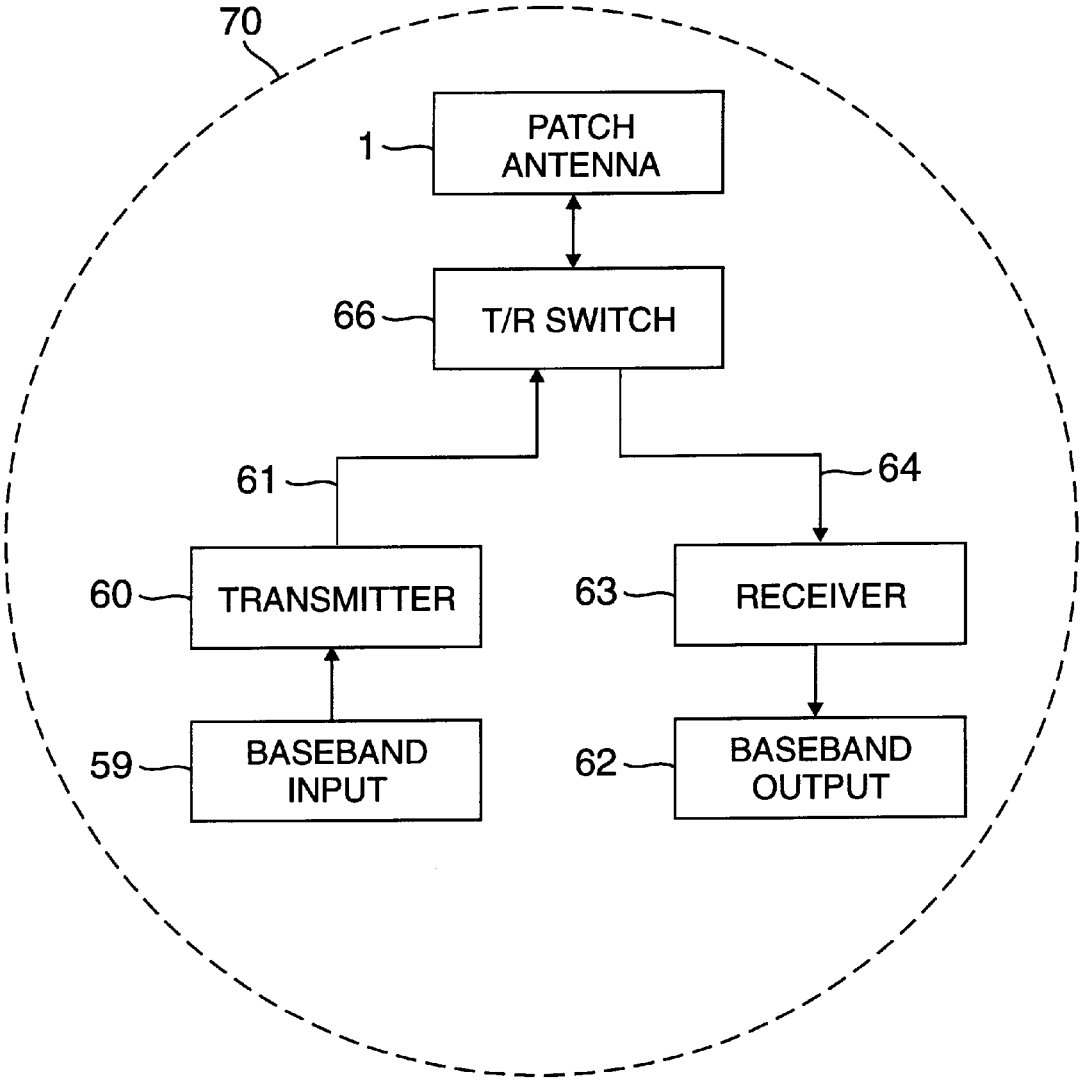
FIG. 7 depicts a communication system according to the present invention.

The patch antenna 1 of the present antenna is intended to operate over frequencies ranging from about 1 GHz to 100 GHz. It was previously noted that in a preferred embodiment, the impedance of the feed ports 11 should be about 50 Ω. Such a port impedance is convenient for integrating the antenna 1 with, for example, a transmitter, a receiver, or both. As shown in FIG. 7, any of the above described patch antennas, such as patch antenna 1, may comprise part of a communication system 70. The communication system 70 may be, for example, a cellular phone or a compact base station for use, for example, in local area networks or for serving electronic label systems.

In communication system 70, the patch antenna is electrically connected to a transmitter 60 and/or receiver 63 by way of electrical connections 61 and 64, respectively. The transmitter 60, in conjunction with other suitable electronics known to those skilled in the art, modulates a carrier signal by a base band input signal 59, such as a voice signal. The modulated carrier signal is then transmitted by the transmitter 60 and the patch antenna 1. The patch antenna 1 and the receiver 63, in conjunction with other suitable electronics known to those skilled in the art, receives and demodulates a carrier signal to provide a baseband output signal 62, such as a voice signal.

In the embodiment of the communication system 70 shown in FIG. 7, one patch antenna 1 is connected to both the transmitter 60 and receiver 63. A transmit-receive or T/R switch 66 is used to establish electrical connection between either the patch antenna 1 and the transmitter 60 or the patch antenna 1 and the receiver 63. Alternatively, a first antenna could be connected to the transmitter 60 and a second antenna could be connected to the receiver 63, at least one of which antennas should be a patch antenna 1 according to the present invention.

In conjunction with using the patch antenna 1 in the communication system 70, the ground plane 13 of the patch antenna 1 is preferably extended by connecting it to, for example, the cellular phone case, if the case is metallized.

It should be understood that the embodiments described herein are illustrative of the principles of this invention and that various modifications may occur to, and be implemented by, those skilled in the art without departing from the scope and spirit of the invention.

We claim:

1. A miniature, multi-branch patch antenna having reduced coupling between antenna elements, comprising:

a planar dielectric substrate having a first and a second surface;

a plurality of conducting antenna elements disposed on the first surface of the dielectric substrate;

a plurality of feed ports for delivering a first signal to, or receiving a second signal from, the plurality of conducting antenna elements, wherein each conducting antenna element is electrically connected to a feed port of the plurality, wherein a different feed port is connected to each of the conducting antenna elements;

a ground plane disposed on the second surface of the planar dielectric substrate; and a septum disposed on the first surface of the dielectric substrate between the plurality of conducting antenna elements and in electrical contact with the ground plane, the septum traversing the first surface of the planar dielectric so that each conducting antenna element of the plurality is separated from all other such conducting antenna elements by the septum and wherein none of the conducting antenna elements is surrounded on four sides by the septum.

2. The miniature, multi-branch patch antenna of claim 1 wherein the plurality of conducting antenna elements consists of four conducting antenna elements.

3. The miniature, multi-branch patch antenna of claim 1 wherein adjacent conducting antenna elements of the plurality are spatially arranged on the planar dielectric substrate so that when the first signal is delivered to each of the adjacent conducting antenna elements, which first signal results in the generation of an electric field between each conducting antenna element and the ground plane, the generated electric fields of the adjacent conducting antenna elements are orthogonal with respect to each other.

4. The miniature, multi-branch patch antenna of claim 1 wherein the feed port of each conducting antenna element of the plurality is located along a symmetry axis of the conducting antenna element.

5. The miniature, multi-branch patch antenna of claim 4 wherein the feed port of each conducting antenna element of the plurality is located off-center on the symmetry axis to achieve a desired impedance for the feed port.

6. The miniature, multi-branch patch antenna of claim 5 wherein the desired impedance is 50 ohms.

7. The miniature, multi-branch patch antenna of claim 1 wherein the plurality of conducting antenna elements have a length that is about one-half of a wavelength of the first or second signal as measured in the dielectric substrate.

8. The miniature, multi-branch patch antenna of claim 1, the dielectric substrate having an effective dielectric constant, wherein adjacent conducting antenna elements are spaced from each other according to the relation $\lambda_0/2\sqrt{\epsilon_{eff}}$, where $\lambda_0$ is the wavelength of a carrier signal in a vacuum and $\epsilon_{eff}$ is the effective dielectric constant.

9. The miniature, multi-branch patch antenna of claim 1 wherein the dielectric substrate has a thickness that defines sidewalls extending from the first surface to the second surface and wherein the septum comprises a layer of metal, wherein the metal extends over the sidewalls of the dielectric substrate to contact the ground plane.

10. The miniature, multi-branch patch antenna of claim 1 wherein the septum comprises a plurality of via holes.

11. The miniature, multi-branch patch antenna of claim 1 wherein the dielectric substrate is $BaTiO_3$.

12. The miniature, multi-branch patch antenna of claim 1 wherein the dielectric substrate has a relative dielectric constant in the range of about 20 to 90.

13. The miniature, multi-branch patch antenna of claim 1 wherein the feed port is a metallized hole.

14. A patch antenna comprising:

a planar dielectric substrate having a first and a second surface;

a plurality of conducting antenna elements, wherein each conducting antenna element of the plurality is electrically isolated from all other conducting elements and is disposed on the first surface of the dielectric substrate;

a plurality of feed ports for delivering a first signal to, or receiving a second signal from, the plurality of conducting antenna elements, wherein each conducting antenna element is electrically connected to a feed port of the plurality, wherein a different feed port is connected to each of the conducting antenna elements;

a ground plane disposed on the second surface of the planar dielectric substrate;

a septum for blocking surface waves from propagating from one conducting antenna element to another along the first surface of the dielectric substrate, wherein the septum is disposed on the first surface of the dielectric substrate between the plurality of conducting antenna elements, and further wherein the septum is in electrical contact with the ground plane; and a dielectric superstrate disposed on the plurality of conducting antenna elements and on at least a portion of the first surface of the dielectric substrate.

15. The patch antenna of claim 14 wherein the plurality of conducting antenna elements consists of four conducting antenna elements.

16. The patch antenna of claim 14 wherein adjacent conducting antenna elements of the plurality are spatially arranged on the planar dielectric substrate so that when the first signal is delivered to each of the adjacent conducting antenna elements, which first signal results in the generation of an electric field between each conducting antenna element and the ground plane, the generated electric fields of the adjacent conducting antenna elements are orthogonal with respect to each other.

17. The patch antenna of claim 14 wherein the feed port of each conducting antenna element of the plurality has an impedance of 50 ohms.

18. The patch antenna of claim 14 wherein the feed port of each conducting antenna element of the plurality is located along a symmetry axis of the conducting antenna element.

19. The patch antenna of claim 14 wherein the dielectric substrate has a relative dielectric constant ranging from about 20–90.

20. The patch antenna of claim 14 wherein the dielectric superstrate has a relative dielectric constant that is approximately the square root of the relative dielectric constant of the dielectric substrate.

21. The miniature, multi-branch patch antenna of claim 14 wherein the dielectric superstrate has a thickness of about one-quarter of a wavelength of the first or second signal as measured in the superstrate.

22. The patch antenna of claim 14 wherein the dielectric superstrate is segmented into a plurality of smaller dielectric superstrates, wherein one smaller dielectric superstrate of the plurality is disposed on each of the conducting antenna elements of the plurality such that the smaller dielectric superstrate disposed on each conducting antenna element does not physically contact the smaller dielectric superstrate disposed on any other conducting antenna element.

23. The patch antenna of claim 22 wherein each of the smaller dielectic superstrates of the plurality is characterized as having four sides and an upper surface, and further wherein a layer of metal is disposed on no more than three of the sides of the smaller dielectric superstrate disposed on each conducting antenna element.

24. The patch antenna of claim 23 wherein the layer of metal is in electrical contact with the ground plane.

25. A communications system comprising:

a receiver operative to receive and demodulate a first carrier signal to provide a base band output signal;

a transmitter operative to transmit a second carrier signal modulated by a base band input signal;

at least one patch antenna comprising a planar dielectric substrate having a first and a second surface;

a plurality of conducting antenna elements disposed on the first surface of the dielectric substrate;

a plurality of feed ports for delivering the second carrier signal to, or receiving the first carrier signal from, the plurality of conducting antenna elements, wherein each conducting antenna element is electrically connected to a feed port of the plurality, wherein a different feed port is connected to each of the conducting antenna elements;

a ground plane disposed on the second surface of the planar dielectric substrate; and a septum disposed on the first surface of the dielectric substrate between the plurality of conducting antenna elements and in electrical contact with the ground plane, the septum traversing the first surface of the planar dielectric so that each conducting antenna element of the plurality is separated from all other such conducting antenna elements by the septum and wherein none of the conducting antenna elements is surrounded on four sides by the septum;

wherein at least one of the receiver and the transmitter is electrically connected to at least two of the feed ports of the at least one patch antenna.

26. The communication system of claim 25 wherein both the receiver and transmitter are electrically connected to the at least one patch antenna.

27. The communication system of claim 25 comprising a first and second patch antenna wherein the receiver is coupled to the first patch antenna and the transmitter is coupled to the second patch antenna.

28. A method of making a miniature, multi-branch patch antenna comprising the steps of:

(a) disposing a layer of metal on a first and a second surface of a dielectric substrate characterized by a high dielectric constant;

(b) patterning at least two conducting antenna elements in the layer of metal on the first surface of the dielectric substrate;

(c) forming a feed port in each of the at least two conducting antenna elements.

(d) forming at least two superstrates, one for each conducting antenna element, wherein each superstrate is characterized as having four sides and an upper surface;

(e) metallizing no more than three sides of each superstrate; and (f) disposing the superstrates on the dielectric substrate so that one of the at least two superstrates covers one of the at least two conducting antenna elements and the other of the at least two superstrates covers the other of the at least two conducting antenna elements; wherein the superstrates are sized so that when disposed on the dielectric substrate, there is no physical contact between any one superstrate and any other superstrate, and wherein each conducting antenna element is separated from all other such conducting antenna elements by at least one metallized side of the superstrate covering the antenna element.

* * * * *